US008408664B2

(12) United States Patent
Park et al.

(10) Patent No.: US 8,408,664 B2
(45) Date of Patent: Apr. 2, 2013

(54) DAMPER EMBEDDED IN A HOME BAR DOOR OF A REFRIGERATOR AND METHOD FOR MANUFACTURING SAME

(75) Inventors: Jung Min Park, Masan-si (KR); Tae Ho Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 696 days.

(21) Appl. No.: 11/908,783

(22) PCT Filed: Mar. 16, 2006

(86) PCT No.: PCT/KR2006/000947

§ 371 (c)(1),
(2), (4) Date: Jun. 13, 2008

(87) PCT Pub. No.: WO2006/098591

PCT Pub. Date: Sep. 21, 2006

(65) Prior Publication Data

US 2008/0278049 A1 Nov. 13, 2008

(30) Foreign Application Priority Data

Mar. 16, 2005 (KR) ..... 10-2005-0021854
Mar. 16, 2005 (KR) ..... 10-2005-0021855
Mar. 16, 2005 (KR) ..... 10-2005-0021857

(51) Int. Cl.
*A47B 96/00* (2006.01)

(52) U.S. Cl. ..... 312/405; 312/292

(58) Field of Classification Search ..... 312/405, 312/321.5, 405.1, 292; 49/501, 394; 62/441
See application file for complete search history.

(56) References Cited

U.S. PATENT DOCUMENTS 1,651,782 A * 12/1927 De Stefani ..... 312/405
2,136,558 A * 11/1938 Manshel ..... 62/266
2,976,577 A * 3/1961 Gould ..... 264/46.6
3,619,482 A * 11/1971 Boor ..... 174/152 G
3,643,464 A * 2/1972 Hilliker et al. ..... 62/344
4,087,140 A * 5/1978 Linstromberg ..... 312/292
4,306,757 A * 12/1981 Horvay et al. ..... 312/292
4,419,307 A * 12/1983 Kohara et al. ..... 264/46.5
4,586,347 A * 5/1986 McCarty ..... 62/265

(Continued)

FOREIGN PATENT DOCUMENTS

EP 1 424 529 A2 6/2004
GB 2 438 766 A 5/2007

(Continued)

*Primary Examiner* — James O Hansen
*Assistant Examiner* — Daniel Rohrhoff
(74) *Attorney, Agent, or Firm* — Birch, Stewart, Kolasch & Birch, LLP

(57) ABSTRACT

A refrigerator and a method for manufacturing the same are disclosed. A refrigerator according to the present includes a refrigerator body (10); a refrigerator door (20) for opening/closing the body; an opening (30) formed in front of the refrigerator door; a home bar door (50) rotatably coupled to the refrigerator door (20) for opening/closing the opening; a securing unit (80) for selectively securing the home bar door for close up the home bar door tight; and a damping member (90) provided at the refrigerator door (20) or the home bar door (50) for dampening the rotation of home bar door (50). According to the present invention, convenience for a user as well as for smooth opening/closing of home bar door may be improved. Also, damage and noise due to the user opening/closing a home bar door (50) may be reduced.

6 Claims, 10 Drawing Sheets

U.S. PATENT DOCUMENTS

| | | | | |
|---|---|---|---|---|
| 5,209,082 | A * | 5/1993 | Ha | 62/265 |
| 5,306,082 | A * | 4/1994 | Karlin et al. | 312/405 |
| 5,753,155 | A * | 5/1998 | Hanusa | 264/46.5 |
| 6,055,823 | A * | 5/2000 | Baker et al. | 62/265 |
| 6,392,878 | B1 * | 5/2002 | Noh | 361/679.33 |
| 7,059,693 | B2 * | 6/2006 | Park | 312/405.1 |
| 7,108,342 | B2 * | 9/2006 | Shin et al. | 312/405 |
| 7,254,958 | B2 * | 8/2007 | Kim et al. | 62/265 |
| 7,277,277 | B2 * | 10/2007 | Bang | 361/679.55 |
| 7,318,633 | B2 * | 1/2008 | Shin et al. | 312/405 |
| 7,360,278 | B2 * | 4/2008 | Jang et al. | 16/357 |
| 8,186,782 | B2 * | 5/2012 | Choi | 312/405 |
| 2001/0030491 | A1 * | 10/2001 | Maruta | 312/7.2 |
| 2004/0148958 | A1 * | 8/2004 | Park | 62/381 |
| 2004/0178710 | A1 * | 9/2004 | Kim et al. | 312/405 |
| 2004/0256965 | A1 * | 12/2004 | Koons | 312/405 |
| 2005/0132535 | A1 * | 6/2005 | Jang et al. | 16/357 |
| 2005/0144970 | A1 * | 7/2005 | Cho et al. | 62/441 |
| 2006/0152121 | A1 * | 7/2006 | Son et al. | 312/405 |
| 2006/0226750 | A1 * | 10/2006 | Lee et al. | 312/405.1 |
| 2006/0226751 | A1 * | 10/2006 | Park | 312/405.1 |
| 2008/0238279 | A1 * | 10/2008 | Jang | 312/405 |
| 2008/0246380 | A1 * | 10/2008 | Gwak | 312/405 |
| 2008/0252191 | A1 * | 10/2008 | Kim et al. | 312/405.1 |
| 2008/0278049 | A1 * | 11/2008 | Park et al. | 312/405 |
| 2009/0009043 | A1 * | 1/2009 | Gwak | 312/405.1 |
| 2009/0261701 | A1 * | 10/2009 | Yun et al. | 312/405 |
| 2009/0300884 | A1 * | 12/2009 | Morgan et al. | 16/343 |
| 2010/0072870 | A1 * | 3/2010 | Hwang | 312/405 |
| 2010/0084955 | A1 * | 4/2010 | Choi | 312/405 |
| 2010/0084956 | A1 * | 4/2010 | Kim et al. | 312/405.1 |
| 2011/0080083 | A1 * | 4/2011 | Engel et al. | 312/405 |
| 2011/0187255 | A1 * | 8/2011 | Ryu et al. | 312/405 |

FOREIGN PATENT DOCUMENTS

| | | | |
|---|---|---|---|
| JP | 5-288459 | A | 11/1993 |
| JP | 8-233442 | A | 9/1996 |
| KR | 10-2004-0046467 | A | 6/2004 |

* cited by examiner

DAMPER EMBEDDED IN A HOME BAR DOOR OF A REFRIGERATOR AND METHOD FOR MANUFACTURING SAME

TECHNICAL FIELD

The present invention relates to a refrigerator, and more particularly, to a refrigerator which can be used more conveniently as well as having a structure thereof enhanced, and a method for manufacturing the same.

BACKGROUND ART

In general, a refrigerator is an electric appliance which can preserve food fresh at a low temperature. Commonly, a plurality of chambers is provided for preserving food by freezing or refrigerating, and a side of each chamber is opened to put or take out the food. Also, a door is provided at the opened side of each chamber for opening/closing the opened side.

Recently, a home bar has been provided in the door not only for reducing leakage of cold air caused by opening the door quite often, but also for allowing a user to access the food used frequently, such as beverage, e.g., wine and/or beer, without the necessity of opening the door of the refrigerator.

The home bar door includes an opening for defining a front of the refrigerator door, a home bar door for opening/closing the opening. Since the home bar door is opened/closed in a state where the refrigerator door is closed, the food stored in a basket inside of the home bar door is put or taken out by a user.

In the conventional home bar door, a hinge of a pole shape is projected outwardly on a lower end of both side walls of the home bar door, and the hinge is rotatably engaged to a hinge hole formed on each lower end of both inner walls of the opened part. Hence, the home bar door is hingedly coupled with respect to a pair of hinge shafts for opening/closing the home bar door.

Furthermore, in an opening/closing device of the home bar door, a hook is formed at an inner surface of the home bar door, and a hook hole corresponding to the hook is formed at the upper end of the opening. Also, a button is provided at an outer surface of the home bar door.

Thus, in case that a user tries to open the home bar door, he/she operates the button at an inner portion of a handle on the home bar door for detaching the hook connected with the button from the hook hole. Hence, the user pulls the home bar door having the hook detached therefrom and opens the opened part.

However, the related art opening/closing device of the home bar door has some disadvantages as follows.

First, a user should operate the button, and a user s manual work including the grip to open the home bar door increases. Thereby, there is a disadvantage in the related art home bar door that convenience for opening/closing the home bar door may deteriorate. Furthermore, a user using both hands at the same time cannot open/close the home bar door, because it is common in the related art home bar door for him/her to hold, press and operate the handle and button of the home bar door.

Next, the related art home bar door has another disadvantage of damage caused by its radical rotation due to the dropping of the home bar door, as well as noise caused by collision occurring while the related art home bar door is rotated about the hinge shaft and dropped due to its self weight, only to be opened. Thus, the user should continuously hold the outer surface of the home bar door tight, after having unlocking the home bar door, so as to prevent the damage and noise.

DISCLOSURE OF INVENTION

Technical Problem

An object of the present invention is to provide a refrigerator having improved convenience.

Another object of the present invention is to provide a refrigerator having damage and noise reduced, which may be caused by opening/closing a home bar door.

Technical Solution

To achieve these objects and other advantages and in accordance with the purpose of the invention, as embodied and broadly described herein, a refrigerator and a method for manufacturing the same includes: a refrigerator body; a refrigerator door for opening/closing the refrigerator body; an opening formed in front of the refrigerator door; a home bar door rotatably coupled to the refrigerator door for opening/closing the opening; a securing unit for selectively securing the home bar door for closing up the home bar door tight; and a damping member provided at the refrigerator door or the home bar door for dampening the rotation of home bar door.

Preferably, the damping member is provided on a shaft of the home bar door. Also, the damping member comprises a rotation shaft projected outwardly, and a damper hole is provided at the refrigerator door or the home bar door, where the damping member is not provided.

Preferably, the damping member is provided within the refrigerator or the home bar door. The securing unit includes an engaging member provided at either the refrigerator door or the home bar door; and an engaging assembly provided at the other of the refrigerator door or the home bar door where the engaging member is not provided, the engaging assembly having an engaging groove for allowing the engaging member selectively engaged thereto.

The home bar door is unlocked by pressing the engaging member inserted into the engaging assembly. Preferably, the engaging member is provided at the upper portion of the home bar door. And the engaging assembly is provided at the portion corresponding to the engaging member.

Meanwhile, the home bar door includes: a base plate defining an interior surface of the home bar door; a cover plate defining an exterior surface of the home bar door, the cover plate connected with the base plate for forming airtight space between the base plate and itself; and a filler filled within the airtight space. Also, preferably a filler injection opening is formed at a side of the home bar door for injecting the filler.

The filler injection opening may be provided at the lower portion of the rotation shaft of home bar door. Also, the damping member may be fixedly embedded in the home bar door by the filler in the airtight space.

Preferably, an engaging-member-securing recess is provided at the base plate for securing the engaging member thereto. A fastening boss may be projected from the engaging-member-securing recess toward the outside of home bar door for having pre-determined fastening members fastened thereto.

In another aspect of the present invention, a method for manufacturing a refrigerator includes steps of: engaging a damping member to a base plate or a cover plate which define a home bar door rotatably coupled to a refrigerator door; connecting the base plate and the cover plate; and injecting a filler into the home bar door through a filler injecting opening at the side of home bar door.

Furthermore, a step of engaging the engaging member to the base plate may be included before the step of connecting the base plate and the cover plate.

Advantageous Effects

A refrigerator and a method for manufacturing the same according to the present invention has an advantageous effect of improved convenience for a user as well as smooth opening/closing of home bar door, because a home bar door on a refrigerator door may be opened/closed by a user simple pushing.

A refrigerator and a method for manufacturing the same according to the present invention has another advantageous effect of reducing damage and noise due to the user opening/closing a home bar door.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
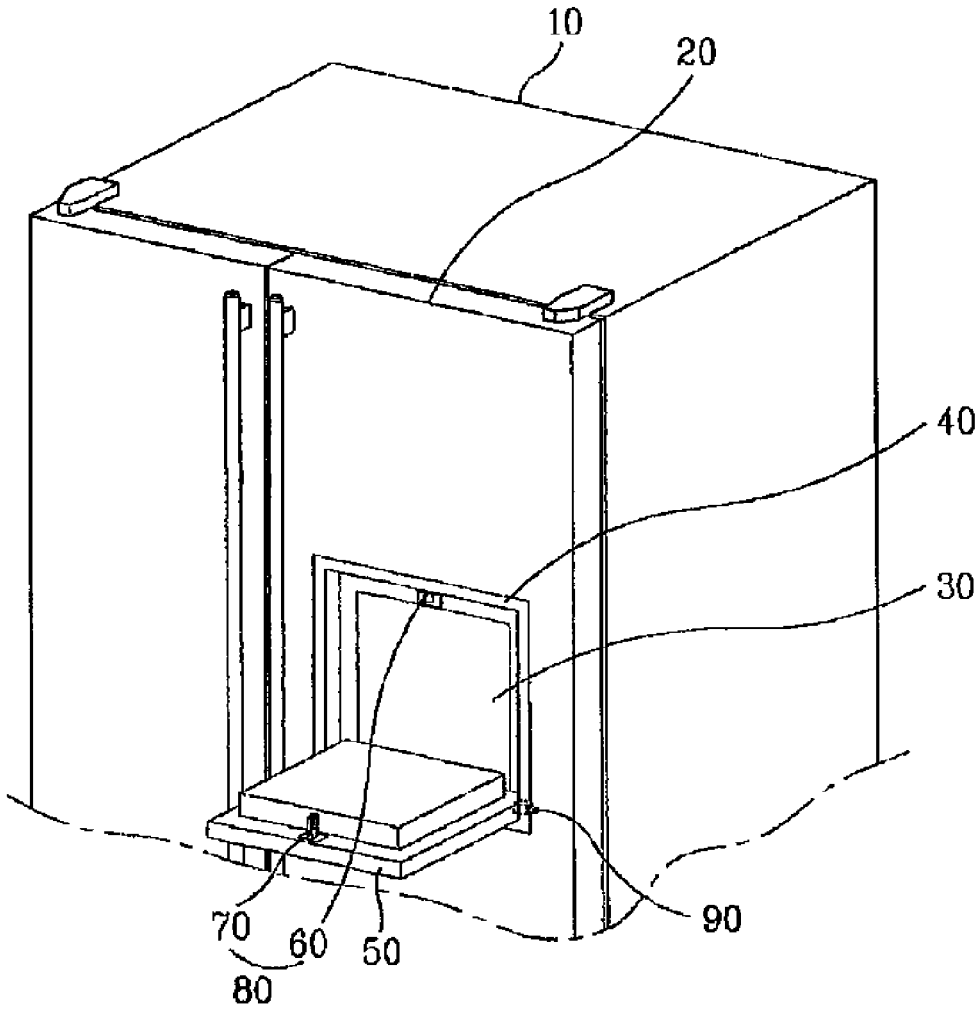
FIG. 1 is a perspective view of a refrigerator according to the present invention.
Figure 2:
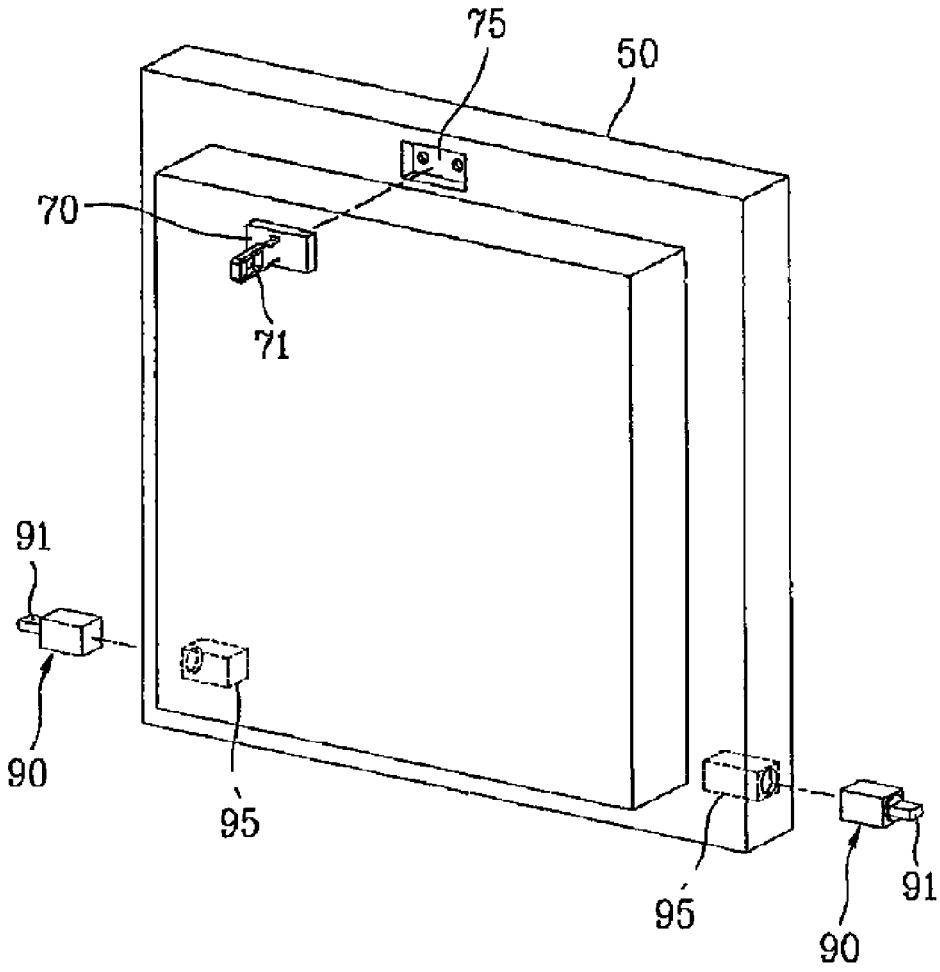
FIG. 2 is a perspective view of a home bar door in FIG. 1.
Figure 3:
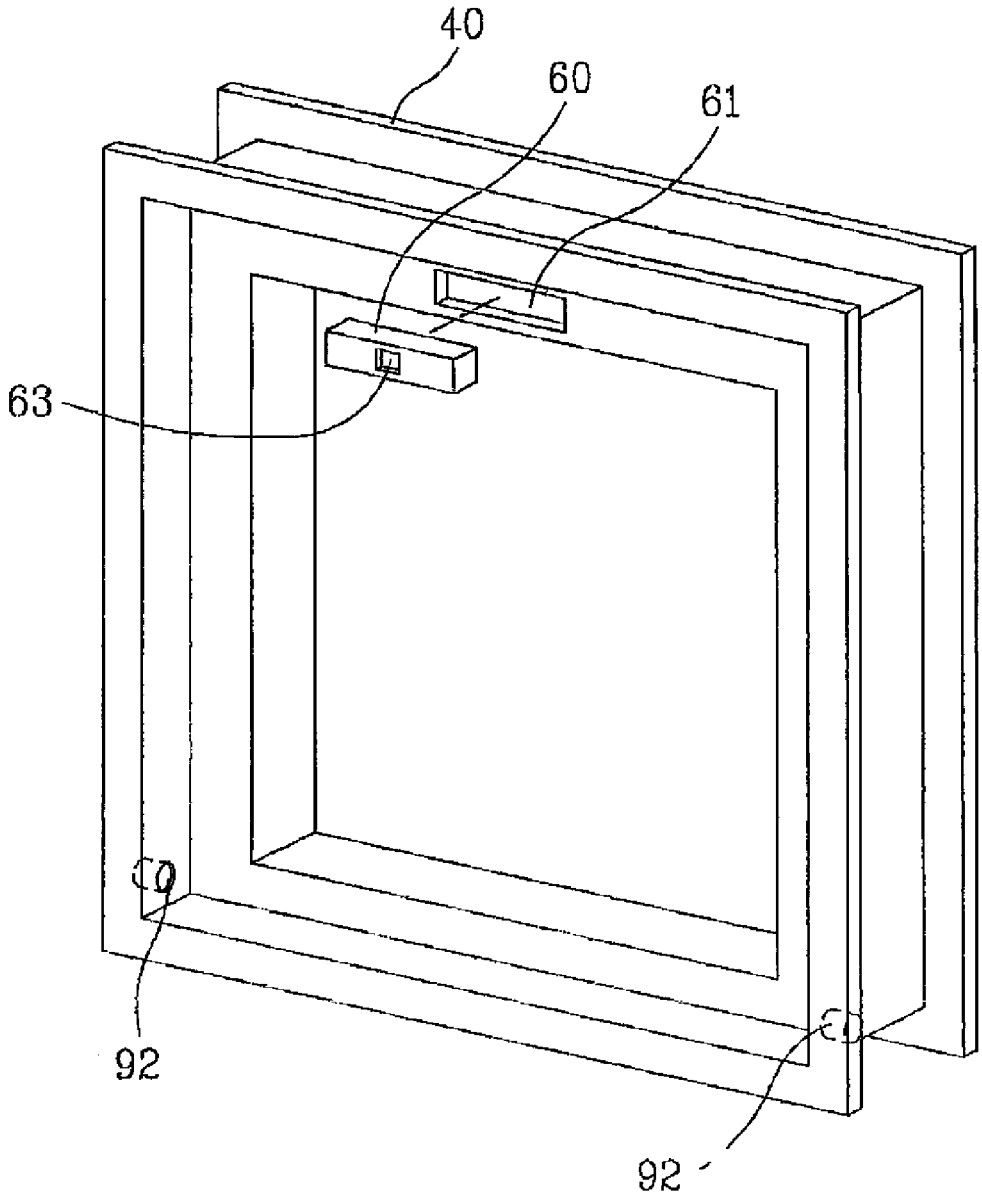
FIG. 3 is a perspective view of a home bar frame in FIG. 1.

Referring to FIGS. 1 to 3, basic components of a refrigerator according to the present invention will be described.

As shown in FIG. 1, a refrigerator according to the present invention includes a refrigerator body 10, a refrigerator door 20 for opening/closing the refrigerator body 10, an opening 30 formed in a front of the refrigerator door, a home bar door 50 for opening/closing the opening, a securing unit 80 for selectively securing the home bar door 50, and a damping member 90 provided on the home bar door 50 for dampening the rotation of the home bar door 50.

The refrigerator body 10 is in an appearance having a front side opened, and the refrigerator door 20 opens/closes the body 10.

The opening 30 is formed in front of the refrigerator door 20, and in communication with inside of the refrigerator storage chamber. Preferably, the opening 30 is provided in a position where a basket is formed for allowing the food within the basket in the refrigerator door put or taken out more conveniently.

Preferably, a home bar frame 40 is formed at the rim of opening 30 provided in the refrigerator door 20 for defining an exterior of the opening 30.

The home bar frame 40 is attached to the inner circumferential surface of the opening 30 for finishing the refrigerator door 20 and the opening 30, and supports an operation of a home bar door 50 which will be described later.

Also, the home bar frame 40 is a frame inserted on the inner circumferential surface of the opening 30, and allows an exterior material provided on a front thereof, which has the same appearance as the front appearance of the refrigerator door 20.

A damping hole 92 is formed on both inner surface of the home bar frame 40 for allowing a rotation shaft of the damping member 90 fastened thereto.

The home bar door 50 is rotatably coupled to the refrigerator door, more specifically, to the home bar frame for opening/closing the opening 30, and made of a plate-shaped member having the same appearance as the appearance of the opening 30.

The securing unit 80 selectively secures the home bar door 50 for making the opening 30 air tight.

More specifically, the securing unit 80 includes an engaging member 70 provided at the refrigerator door 20 or the home bar door 50, an engaging assembly 60 provided at the other of the refrigerator door 20 and the home bar door 50, where the engaging member is not provided, for maintaining the closed state of home bar door 50.

According to an embodiment, as shown in FIG. 1, it is embodied that the engaging member 70 is provided at the home bar door 50 and the engaging assembly 60 is provided in the refrigerator door 20, more specifically, at the home bar frame 40.

As shown in FIG. 2, the engaging member 70 is formed in a plate-shape with an opening in a center thereof, and inserted to the engaging groove 63 grooved in the center of the engaging assembly 60. Also, an engaging hook 71 is projected from the center of the engaging member 70 toward an inner direction of the home bar door 50.

The engaging member 70 is provided at an end of the home bar door 50 corresponding to the engaging assembly 60, and, in the embodiment it is provided on the upper end of the home bar door inner surface.

The engaging assembly 60 is provided on the upper portion of the home bar frame 40 formed in the refrigerator door 20 for maintaining, together with the engaging member 70, a state where the home bar door 50 is closed. The engaging assembly 60 may be formed in several ways, and the embodiment presents the engaging assembly 60 is a latch.

The engaging assembly 60 is insertedly engaged to an end of the home bar frame 40, according to the embodiment, to a recess 61 on the front upper end of the home bar frame 40. The recess 61 of a box shape is recessed inwardly from the front upper end of the home bar frame 40.

In FIG. 3, the engaging assembly 60 has the engaging groove 63 allowing the engaging member 70 selectively engaged thereto. Thus, a rotatory hook secures the engaging member 70, inserted into the engaging groove 63, by hooking or the rotatory hook is detached with the engaging member 70 detached together.

The engaging assembly 60 is insertedly secured to the recess 61 on the home bar frame 40.

Furthermore, the engaging member 70 is inserted into the engaging groove 63 and, together with that, a front end of the engaging member 70 presses the hook to rotate the hook with allowing the hook inserted to the opening of engaging member 70. Thereby, the engaging member 70 is secured within the engaging assembly. Alternatively, the engaging member 70 is re-pressed to detach the hook from the opening of the engaging member 70. Thereby, the engaging member 70 moves free.

Meanwhile, the engaging assembly 60 is fixedly embedded by a filler filled within the home bar frame 40, for example heat insulator, together with that the engaging assembly 60 is inserted into the recess 61.

The damping member 90 provided on a rotation shaft of the home bar door 50 dampens the rotation of home bar door 50. Also, the damping member 90 has a damping-member-rotation-shaft 91 projected outwardly, and has a resilient spring fastened therein or oil filled therein for dampening rotation of the damping member rotation shaft 91.

In the embodiment, the damping member 90 is provided at both side ends of the door 20, and fixedly embedded in the damping recess 95 formed at the both ends of the home bar door 50 for allowing the home bar door 50 to rotate.

Alternatively, the damping member 90 may be secured to the damping recess 95 formed on an inner side of the home bar door 50 by a fastening member, and secured within the home bar door 50 by the filler filled in the home bar door 50.

Figure 4:
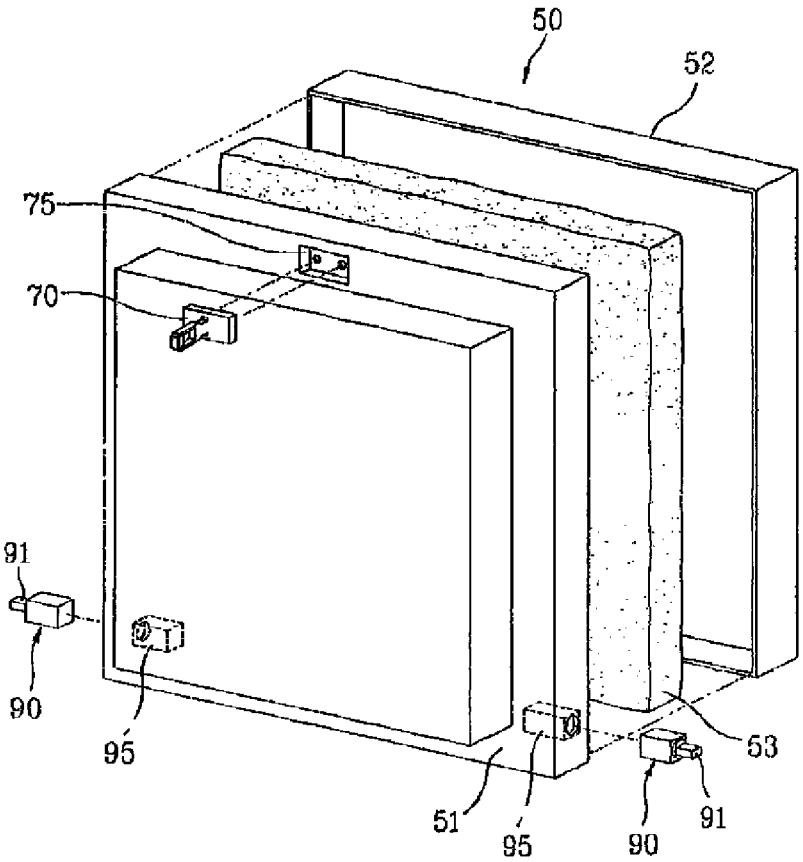
FIG. 4 is an exploded perspective view illustrating an inner structure of a home bar door in FIG. 3.
Figure 5:
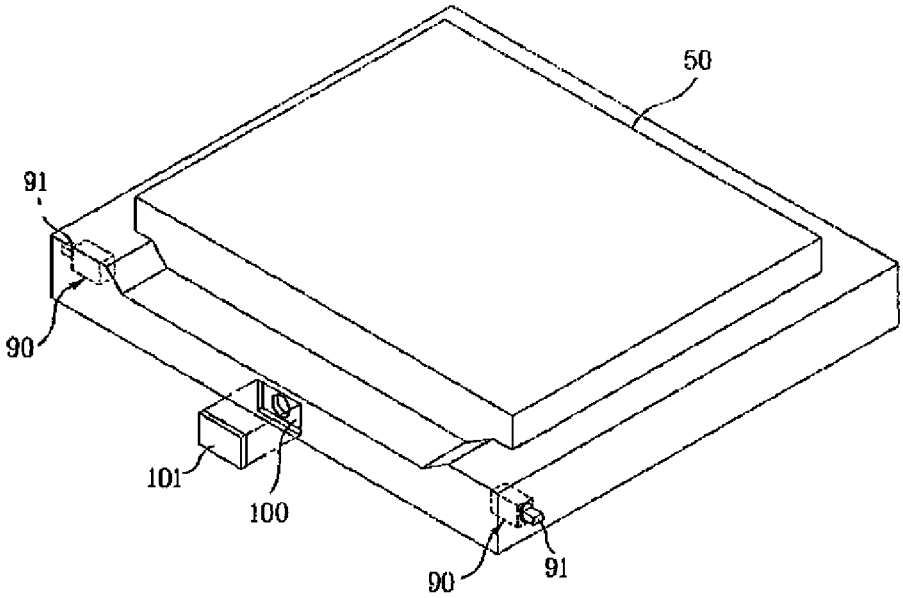
FIG. 5 is an exploded perspective view illustrating an appearance of a filler injection opening of a home bar door in FIG. 3.

Referring to FIGS. 4 and 5, an inner structure of the home bar door and a structure for a filler will be described.

As shown in FIG. 4, the home bar door 50 includes a base plate 51, a cover plate 52 and a filler 53.

The base plate 51 defines an interior surface of the home bar door in a state where the home bar door 50 is closed, and is formed in a box shape having an opened side after being connected with a cover plate.

The cover plate 52 defines an exterior surface of the home bar door in a state where the home bar door is closed, and formed in a box shape having an opened side, after connected with the base plate 51, to form airtight space between the base plate 51 and itself.

Also, the filler 53 is filled within the airtight space between the base plate 51 and the cover plate 52.

The filler 53 supports inside components of the home bar door 50 and, together with that, insulates an inside and an outside of the home bar door 50 each other. The fluidal filler 53 is injected and filled along in an inside appearance of the home bar door 50. Hence, the filler 53 is hardened within the home bar door 50 as one body.

The filler 53 is injected into the inside appearance of the home bar door 50 through an injection opening at a side of the home bar door.

In the embodiment of FIG. 5, the injection opening 100 of the filler is formed at a lower portion of the rotation shaft which rotates the home bar door 50 and a front surface of the filler injection opening 100 is covered by an injection opening cover 101 of a plate shape.

Figure 6:
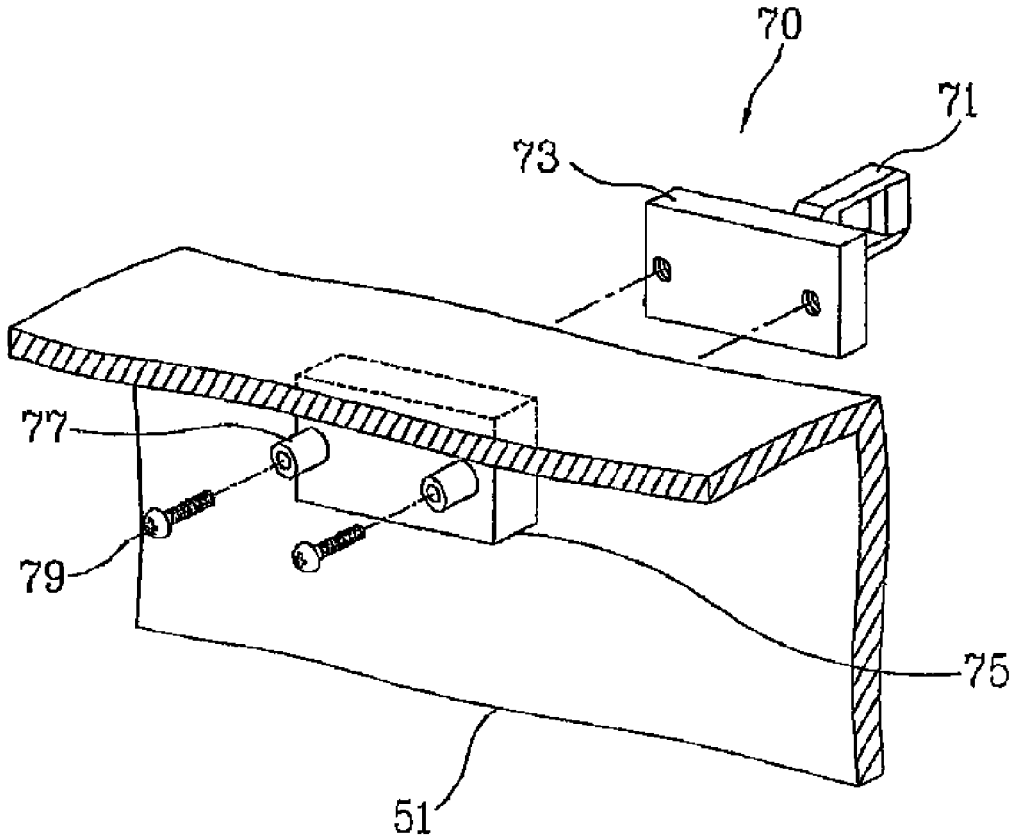
FIG. 6 is a partial perspective view illustrating a state where an engaging member of FIG. 3 is assembled.
Figure 7:
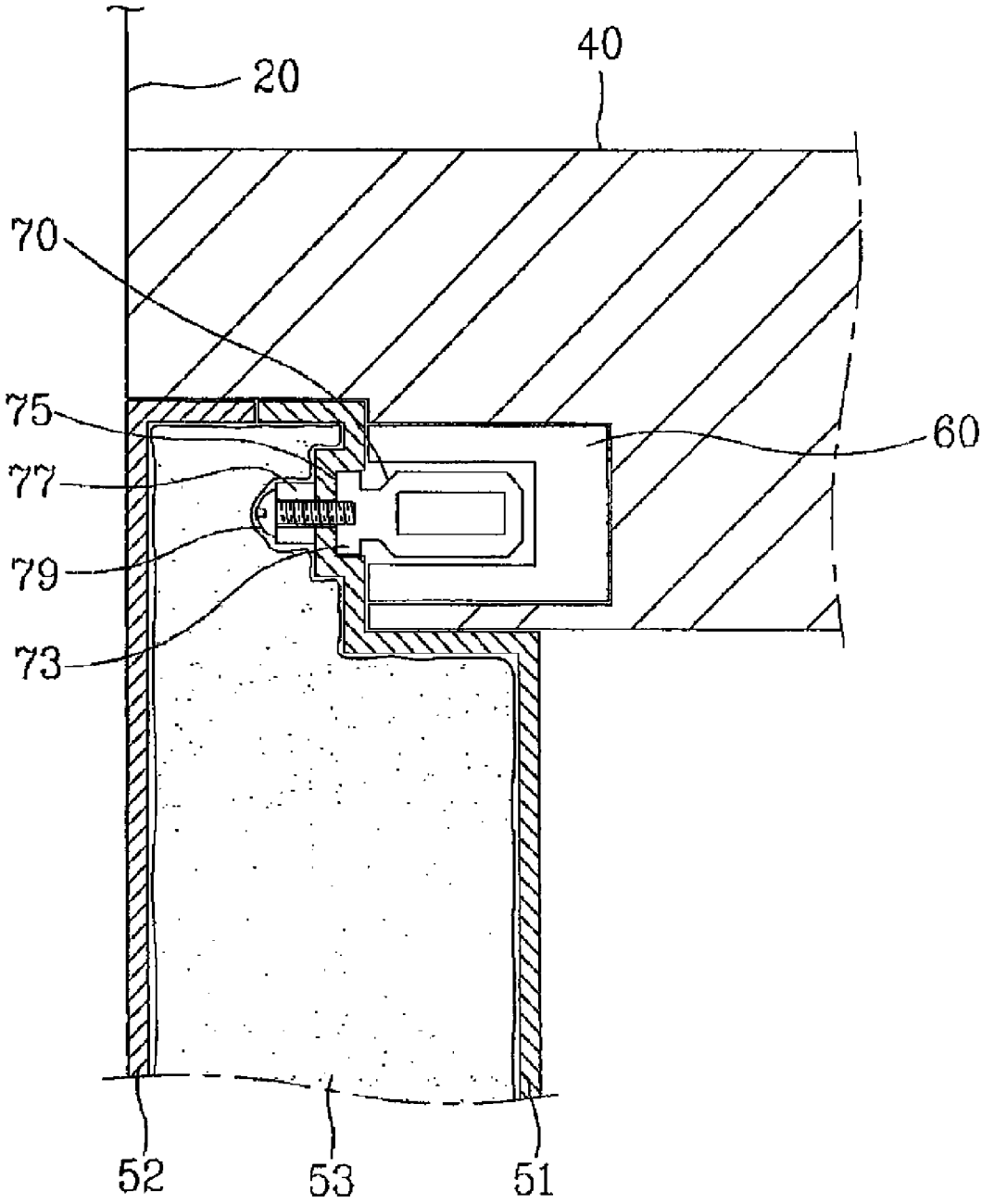
FIG. 7 is a partial sectional view illustrating a state where the engaging member of FIG. 6 is engaged.

Referring to FIGS. 6 and 7, a connecting structure of the engaging member will be described.

The engaging member 70 is provided in the engaging member securing recess 75 at the upper inner end of the home bar door 50, and a center thereof is projected outwardly from the inner surface of the home bar door 50.

A securing plate 73 in a shape corresponding to the engaging-member securing recess 75 is formed at the end of the engaging member 70 for securing the engaging member thereto.

Alternatively, unlike this embodiment, a plurality of protrusions may be projected on an outer circumferential surface of the securing plate 73, and a plurality of recesses corresponding to the protrusions may be recessed on an inner circumferential surface. Thus, the securing plate 73 is inserted into the engaging-member-securing recess 75 with the protrusions inserted into the recesses corresponding to the protrusions, thereby securing the engaging member to the home bar door 50.

Meanwhile, in the embodiment, a pair of fastening bosses in a bar shape is projected toward the outer direction of the home bar door from an inner surface of the engaging-member-securing recess 75. The engaging member 70 is engaged by fastening members 79. More specifically, the fastening member 79 rotatably passes through the fastening boss only to be fastened to the boss. The end of the fastening member 79 is inserted into the securing plate 73 through the boss 77 to fixedly secure the home bar door 50.

The engaging member 70 is provided in an end of the home bar door 50 corresponding to the engaging assembly 60 and, in this embodiment, is engaged to an upper end of a side of the base plate 51.

Meanwhile, since the filler 53 is injected into the home bar door 50 through the filler injection opening 100 and hardened in a state where the engaging member 70 is engaged in the base plate by the fastening member 79, the fastening boss 77 having the fastening member 79 secured thereto may be fixedly secured within the base plate 51.

In another aspect of the present invention, a method for manufacturing the home bar door according the present invention will be described.

First, an engaging member 70 is secured to an upper portion of the base plate, which defines a home bar door 50 of a refrigerator. And, a damping member 90 is secured to both lower ends of the base plate 51. In a state where the engaging member 70 and the damping member 90 are secured, a cover plate 52 is coupled to the base plate 51 to form the home bar door 50.

Here, the engaging member 70 and the damping member 90 may be secured to the base plate 51 and alternatively may be secured to the cover plate 52.

In the state of the home bar door being formed, a filler is injected through the filler injection opening 100. Hence, the filler is filled within the home bar door and fixedly hardened.

The home bar door 50 rotates about a rotation shaft, and a lower portion of the rotation shaft is prevented from being exposed during the rotation of the home bar door 50. Thus, the filler injection opening 100 provided at the lower portion of the rotation shaft may be prevented from being exposed during the rotation of the rotation shaft, too.

Referring to FIGS. 8 to 11, a process for opening/closing the home bar door will be described.

Figure 8:
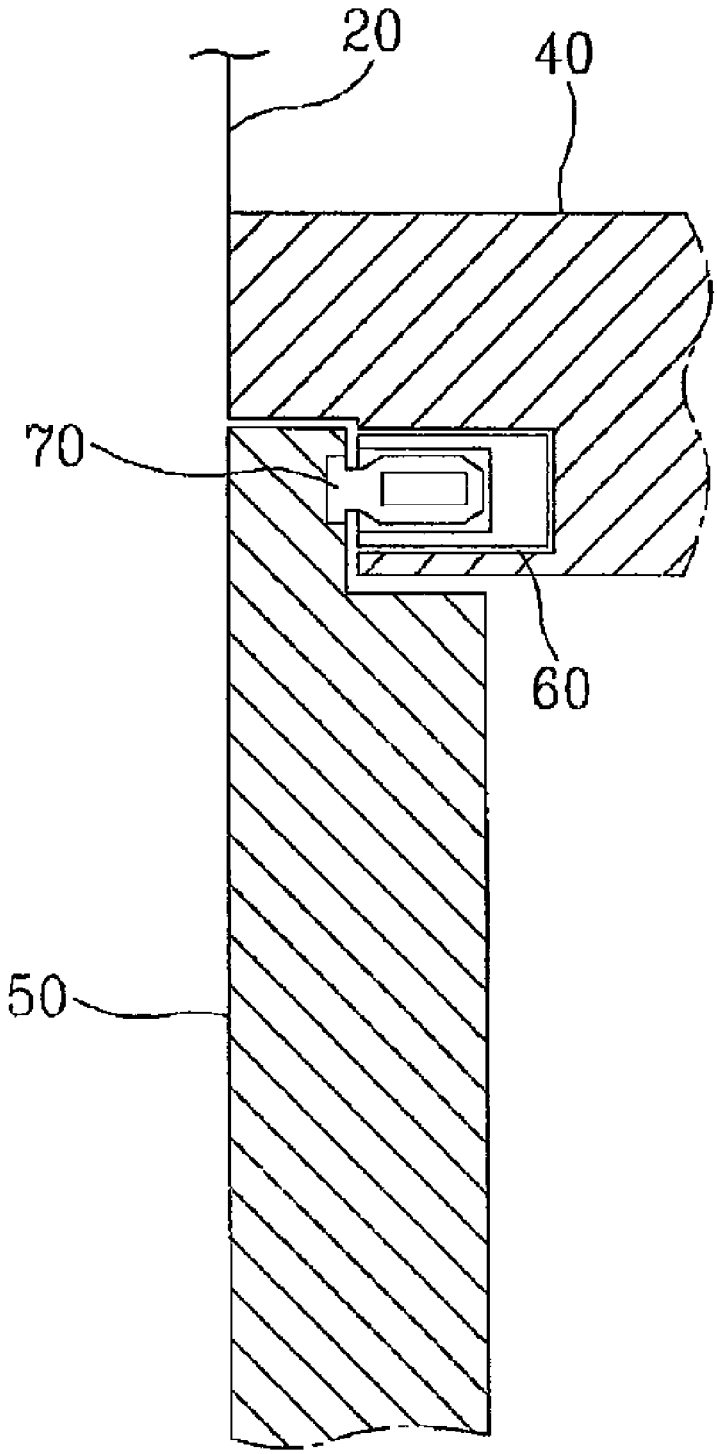
FIG. 8 is a sectional view illustrating a state where the home bar door of FIG. 1 is locked.
Figure 9:
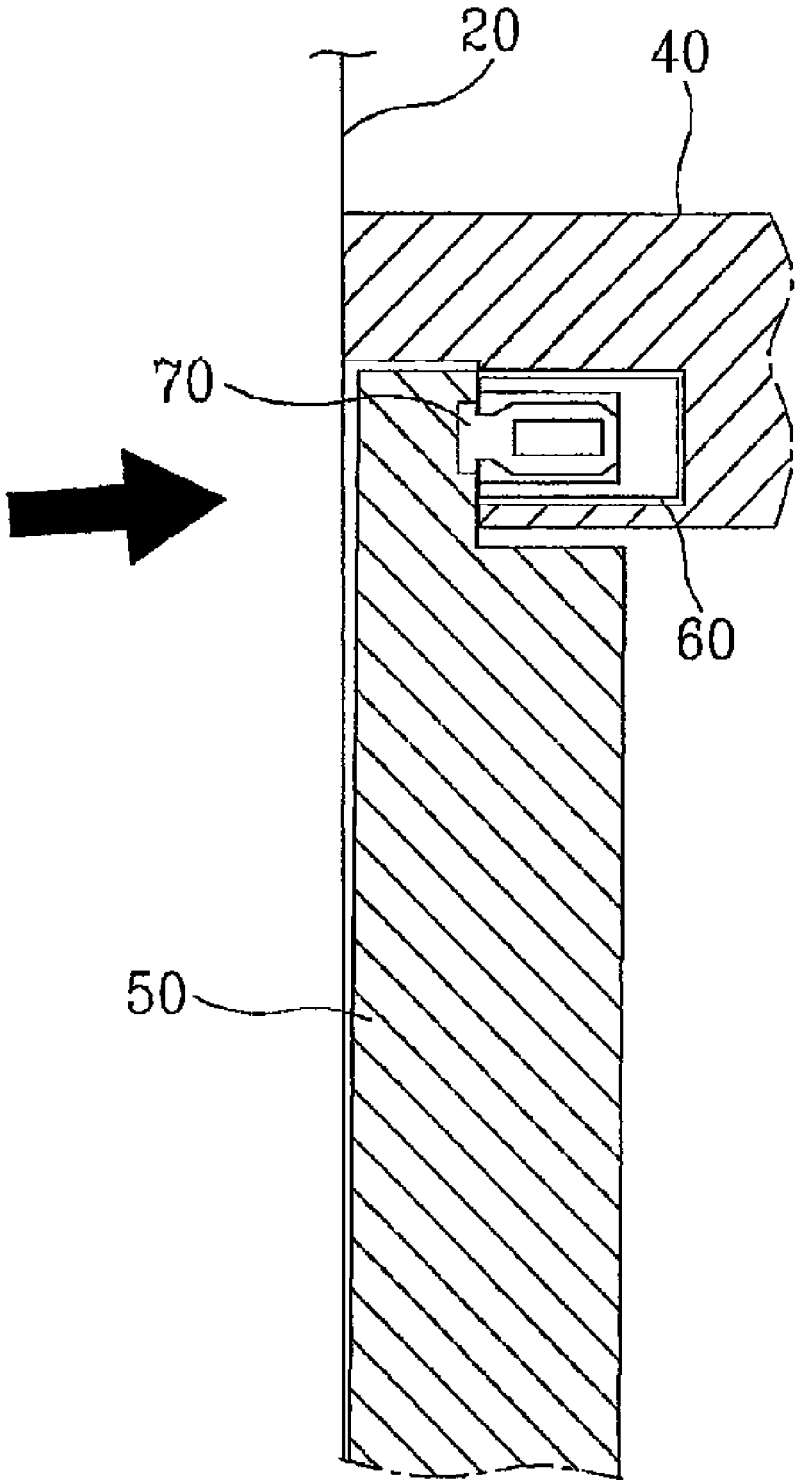
FIG. 9 is a sectional view illustrating a state of pressing the home bar door of FIG. 1.
Figure 10:
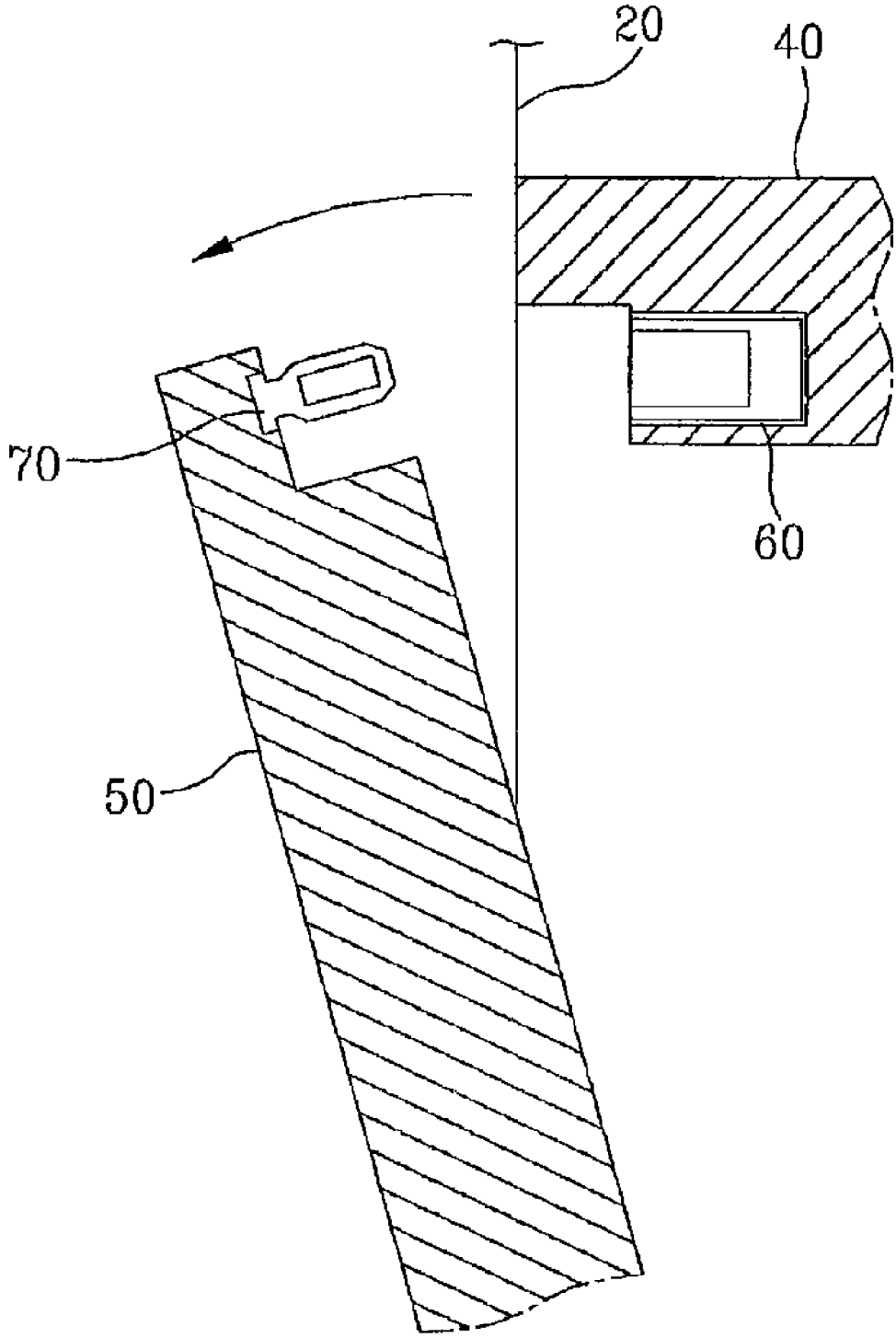
FIG. 10 is a sectional view illustrating a state where the home bar door of FIG. 1 is opened.
Figure 11:
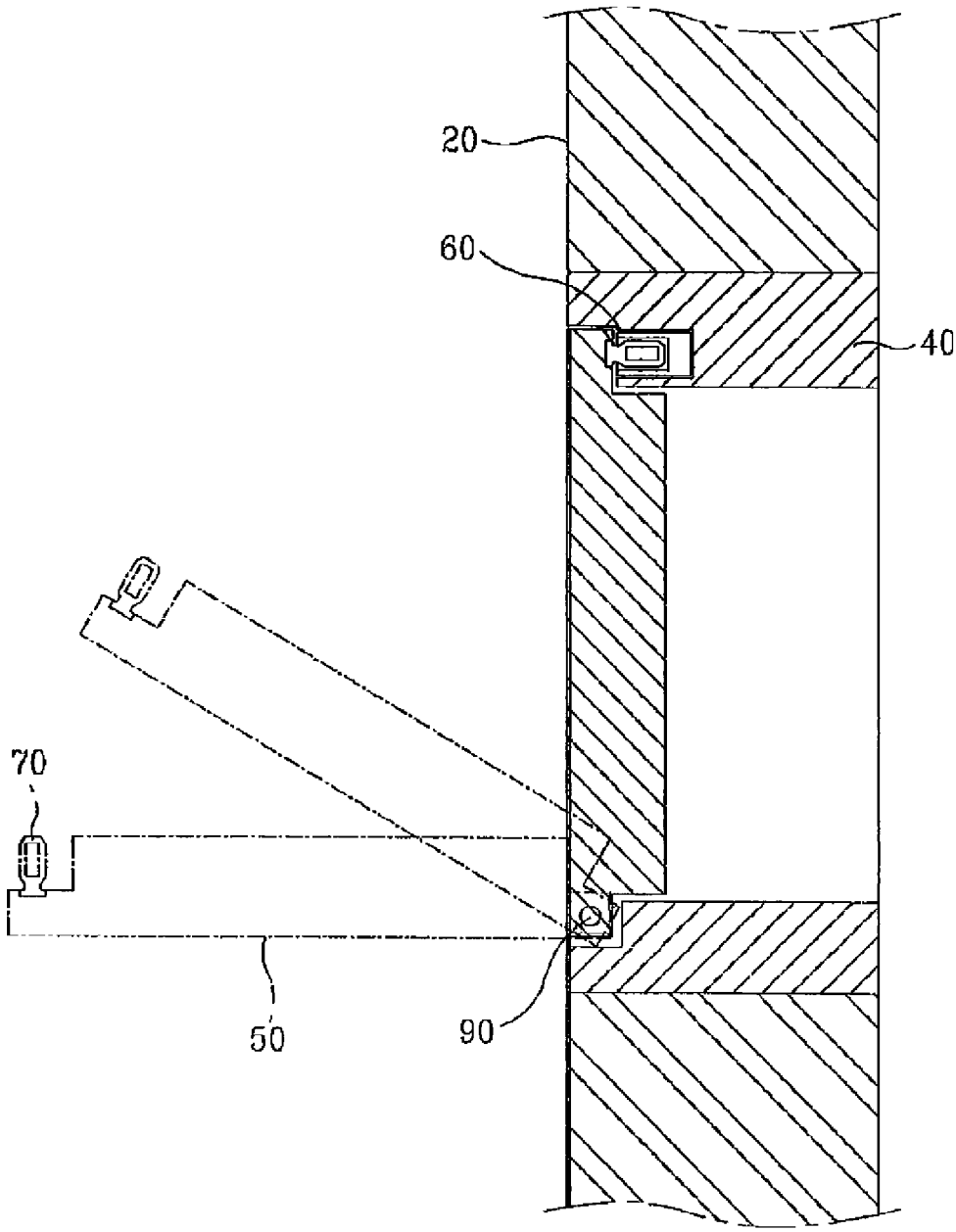
FIG. 11 is a sectional view illustrating a state where the home bar door of FIG. 1 is opened/closed in regular sequence.

FIG. 8 is a sectional view illustrating a state where the home bar door is locked, FIG. 9 is a sectional view illustrating a state of pressing the home bar door, FIG. 10 is a sectional view illustrating a state where the home bar door is opened; and FIG. 11 is a sectional view illustrating a state where the home bar door is opened/closed in regular sequence.

The home bar door 50 of the refrigerator according to the present invention is unlocked by pressing an outer side surface thereof.

First, since the engaging member 70 and the engaging assembly 60 locking the home bar door 50 are formed at the upper end of the home bar door 50, the upper end of the home bar door 50 is pressed inwardly at a predetermined width.

As shown in FIG. 9, once the outer side surface of the home bar door 50 is pressed, the upper end of the home bar door 50 is inserted inwardly in an inner direction of the home bar door with respect to the rotation shaft of damping member 90 at the lower end of the home bar door 50 at a predetermined width.

Together with that, the engaging member 70 engaged to the upper inside end of the home bar door 50 is inserted more within the engaging assembly 60.

As the engaging member 70 is inserted more within the engaging assembly 60, the front end of the engaging member 70 is pressing a hook working part of the engaging assembly 60. Hence, the hook rotates to be detached from the opening of the engaging member 70.

Once the hook of the engaging assembly 60 is detached from the opening of the engaging member 70, the engaging member 70 moves free and is pressed toward the outer direction of the refrigerator door 20 by the elasticity of the hook.

As the engaging member 70 is pressed toward the outer direction of the refrigerator door 20, the home bar door 50 is dropped due to its self weight. At that time, the lower end of home bar door 50 is supported on the home bar frame 40 by the damping member 90. Thus, the home bar door 50 also rotates downwardly about the rotation shaft of damping member 90.

The home bar door 50 rotating downwardly deteriorates in speed by the damping force of the spring or oil applied to the rotation shaft of the damping shaft. Thus, the dropping speed of the home bar door 50 deteriorates.

Generally, the damping force of the damping member 90 is in proportion to the rotation speed. That is, as the rotation speed of the rotation shaft 91 is increasing, the damping force working in the opposite rotation direction of the rotation shaft is also increasing. Accordingly, the more downwardly the home bar door 50 moves with rotating, the higher the rotation speed of the rotation shaft 91 is. Thereby, the damping force increases.

The rotation speed of home bar door 50 dropped due to its self weight increases, and the damping force thereof in an opposite direction of its rotation decreases due to the operation of damping member. Thus, as the rotation speed is dampened, the home bar door 50 is completely opened in a vertical direction of a refrigerator door 20 to open the opened part 30.

When a user tries to close the opening 30 of the refrigerator door 20, he/she presses the outer surface of home bar door 50 and the rotation shaft having the hinge of damping member 90 of the home bar door 50 to allow the upper end of home bar door 50 and the upper end of home bar frame 40 folded. Together with that, the engaging member 70 projected on the upper end of home bar door inside is inserted into the engaging assembly 60 only to be secured to the hook of the engaging assembly 60.

As the engaging member 70 is secured within the engaging assembly 60, the home bar door 50 having the engaging member 70 secured thereto is secured to the engaging assembly 60. Hence, the home bar door 50 is secured to the front surface of the home bar frame 40 to close the opening 30.

Although the embodiment presents that the engaging member 70 is formed at the home bar door 50, alternatively the engaging member 70 may be provided at the home bar frame 40 and the latch assembly may be provided at the corresponding position of the home bar door 50.

On the other hand, although the embodiment presents that the engaging member 70 and the engaging assembly 60 are provided each at the upper end of home bar door 50 and the upper end of home bar frame 40, alternatively the engaging member and the engaging assembly are provided each at a side end or a lower end of the home bar door 50 and a side end or a lower end of the home bar frame.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

Since a home bar door on a refrigerator door may be opened/closed by a user simple pushing, the home bar door according to the present invention has an advantageous industrial applicability of improved convenience for a user as well as smooth opening/closing of home bar door.

Furthermore, since the home bar door is dropped due to its self weight, the home bar door according to the present invention has another advantageous industrial applicability that the refrigerator door and the home bar door may be collided to cause damage as well as any noise caused by the collision.

The invention claimed is:

1. A refrigerator comprising:

a refrigerator body;

a refrigerator door for opening/closing the refrigerator body;

an opening formed in front of the refrigerator door;

a home bar door rotatably coupled to the refrigerator door for opening/closing the opening, the home bar door including:

a base plate defining an interior surface of the home bar door;

a cover plate defining an exterior surface of the home bar door, the cover plate connected with the base plate for forming an airtight space between the base plate and itself;

a filler filled within the airtight space; and a filler injection opening provided at a bottom wall of the cover plate of the home bar door;

a securing unit for selectively securing the home bar door in a closed position and opening the home bar door by pressing a front upper surface of the home bar door to an angle which the home bar door is dropped due to its own weight; and a damping member provided at the base plate of the home bar door for dampening the rotation of the home bar door, the damping member fixedly embedded in the home bar door by the filler in the airtight space, wherein the securing unit comprises:

an engaging member provided at the base plate of the home bar door; and an engaging assembly provided at the refrigerator door, wherein an engaging-member-securing recess is provided at a surface of the base plate for securing an engaging member thereto, wherein a securing plate in a shape corresponding to the engaging-member-securing recess is formed at the end of the engaging member, wherein a fastening boss is provided on an inner surface of the base plate opposite the surface of the base plate having the engaging-member-securing recess, wherein a fastening member is inserted into the securing plate by first passing through the fastening boss and the base plate into the securing plate to fixedly secure the engaging member to the home bar door, and wherein the filler is injected through the filler injection opening after the home bar door is assembled with the engaging member and the damping member.

2. The refrigerator of claim 1, wherein the damping member is provided on the rotation shaft of the home bar door.

3. The refrigerator of claim 1, wherein the damping member includes the rotation shaft projected outwardly, and a damping hole for allowing the rotation shaft of the damping member fastened thereto is provided at the refrigerator door.

4. The refrigerator of claim 1, wherein the engaging assembly has an engaging groove for allowing the engaging member to be selectively engaged thereto.

5. The refrigerator of claim 4, wherein the home bar door is unlocked by pressing the engaging member inserted into the engaging assembly.

6. The refrigerator of claim 4, wherein the engaging member is provided at the upper portion of the home bar door and the engaging assembly is provided at the position of the refrigerator door corresponding to the engaging member.

* * * * *